US007227513B2

(12) United States Patent
Lee et al.

(10) Patent No.: US 7,227,513 B2
(45) Date of Patent: Jun. 5, 2007

(54) PLASMA DISPLAY AND DRIVING METHOD THEREOF

(75) Inventors: Eun Cheol Lee, Kumi-shi (KR); Young Kyo Shin, Seoul (KR)

(73) Assignee: LG Electronics Inc, Seoul (KR)

( * ) Notice: Subject to any disclaimer, the term of this patent is extended or adjusted under 35 U.S.C. 154(b) by 777 days.

(21) Appl. No.: 09/879,170

(22) Filed: Jun. 13, 2001

(65) Prior Publication Data

US 2004/0169621 A9 Sep. 2, 2004

Related U.S. Application Data

(63) Continuation-in-part of application No. 09/440,094, filed on Nov. 15, 1999, now Pat. No. 6,504,519.

(30) Foreign Application Priority Data

Jul. 13, 2000 (KR) ..... 2000-40251
Aug. 9, 2000 (KR) ..... 2000-46222

(51) Int. Cl.
*G09G 3/28* (2006.01)

(52) U.S. Cl. ..... 345/60; 345/67

(58) Field of Classification Search ..... 345/60–68; 315/169.4; 313/584–586, 581, 582, 590
See application file for complete search history.

(56) References Cited

U.S. PATENT DOCUMENTS 4,924,218 A * 5/1990 Weber et al. ..... 345/67
5,168,270 A * 12/1992 Masumori et al. ..... 345/100
5,852,347 A * 12/1998 Marcotte ..... 315/169.4
5,998,935 A * 12/1999 Marcotte ..... 315/169.4
6,118,214 A * 9/2000 Marcotte ..... 313/582
6,188,374 B1 * 2/2001 Moon ..... 345/60
6,195,073 B1 * 2/2001 Lin ..... 345/67
6,288,692 B1 * 9/2001 Kanazawa et al. ..... 345/67
6,344,841 B1 * 2/2002 Moon ..... 345/60
6,373,452 B1 * 4/2002 Ishiii et al. ..... 345/67
6,380,678 B1 * 4/2002 Kim ..... 313/586
6,504,519 B1 * 1/2003 Ryu et al. ..... 345/60

FOREIGN PATENT DOCUMENTS

| | | |
|---|---|---|
| JP | 10144225 | 5/1998 |
| JP | 101999427 | 7/1998 |
| JP | 11120919 | 4/1999 |
| JP | 11288666 | 10/1999 |
| JP | 08-212933 | 5/2002 |

* cited by examiner

*Primary Examiner*—Regina Liang
(74) *Attorney, Agent, or Firm*—Ked & Associates, LLP

(57) ABSTRACT

A plasma display panel and a driving method thereof that is capable of improving a discharge efficiency as well as preventing a crosstalk. In the panel, an address electrode is included in each discharge cell making a unit pixel of the plasma display panel. A plurality of second sustain electrodes are positioned at each periphery of the discharge cell in a direction crossing the address electrode to receive a second sustaining pulse. At least one of first sustain electrode is positioned at the center of the discharge cell in a direction crossing the address electrode to receive a first sustaining pulse applied alternately with respect to the second sustaining pulse.

20 Claims, 17 Drawing Sheets

PLASMA DISPLAY AND DRIVING METHOD THEREOF

This application is a continuation-in-part application of Ser. No. 09/440,094, U.S. Pat. No. 6,504,519 B1 filed on Nov. 15, 1999 and issued on Jan. 7, 2003.

BACKGROUND OF THE INVENTION

1. Field of the Invention

This invention relates to a plasma display panel, and more particularly to a plasma display panel and a driving method thereof that is capable of improving discharge efficiency as well as preventing a crosstalk.

2. Description of the Related Art

Generally, a plasma display panel (PDP) is a display device utilizing a visible light emitted from a fluorescent body when an ultraviolet ray generated by a gas discharge excites the fluorescent body. The PDP has an advantage in that it has a thinner thickness and a lighter weight in comparison to the existent cathode ray tube (CRT) and is capable of realizing a high resolution and a large-scale screen. The PDP includes a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell of the conventional three-electrode, AC surface-discharge PDP includes a scan/sustain electrode 12Y and a common sustain electrode 12Z provided on an upper substrate 10, and an address electrode 20X provided on a lower substrate 18.

The scan/sustain electrode 12Y and the common sustain electrode 12Z are transparent electrodes made from indium-tin-oxide (ITO). Since the ITO has a high resistance value, a signal is applied via bus electrodes 13YB and 13ZB to thereby apply an uniform voltage to each discharge cell On the upper substrate 10 provided with the scan/sustain electrode 12Y and the common sustain electrode 12Z in parallel, an upper dielectric layer 14 and a protective film 16 are disposed. Wall charges generated by plasma discharge are accumulated on the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22, barrier ribs 24 are formed on the lower substrate 18 provided with the address electrode 20X. The surfaces of the lower dielectric layer 22 and the barrier ribs 24 are coated with a fluorescent layer 26. The address electrode 20X is formed in a direction crossing the scan/sustain electrode 12Y and the common sustain electrode 12Z.

The barrier rib 24 is formed in parallel to the address electrode 20X to prevent an ultraviolet ray and a visible light generated by a discharge from being leaked to the adjacent discharge cells. The fluorescent layer 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

FIG. 2 represents an arrangement structure of the overall electrode lines and discharge cells of the PDP shown in FIG. 1.

Referring to FIG. 2, a discharge cell 28 is positioned at each intersection among the scan/sustain electrode lines Y, the common sustain electrode lines Z and the address electrode lines X. The outer edge of the scan/sustain electrode line Y and the common sustain electrode lines Z is provided with the bus electrodes YB and ZB. The barrier ribs 24 are formed in parallel to the address electrode lines X.

Such a three-electrode AC surface-discharge PDP drives one frame, which is divided into various sub-fields having a different emission number, so as to realize gray levels of a picture. Each sub-field is again divided into a reset period for uniformly causing a discharge, an address period for selecting the discharge cell and a sustain period for realizing the gray levels depending on the discharge number. When it is intended to display a picture of 256 gray levels, a frame interval equal to 1/60 second (i.e. 16.67 msec) is divided into 8 sub-fields. Each of the 8 sub-fields is divided into a reset period, an address period and a sustain period. The reset period and the address period of each sub-field are equal every sub-field, whereas the sustain period and the discharge number are increased at a ration of $2^n$ (wherein n=0, 1, 2, 3, 4, 5, 6 and 7) at each sub-field. Since the sustain period becomes different at each sub-field as mentioned above, the gray levels of a picture can be expressed. In order to express the gray levels, driving waveforms as shown in FIG. 3 are applied to each electrode line of the PDP for each sub-field.

Referring to FIG. 3, one sub-field is divided into a reset period for initializing the entire field, an address period for scanning the entire field on a line-sequence basis to write a data, and a sustain period for keeping a light-emission state of the cells into which a data is written.

First, in the reset period, a reset pulse VR is applied to the common sustain electrode line Z to generate a reset discharge between the common sustain electrode line Z and the scan/sustain electrode line Y. When the reset discharge is generated between the common sustain electrode line Z and the scan/sustain electrode line Y, priming charged particles and wall charges are formed at each discharge cell.

In the address period, a scanning pulse −Vs is sequentially applied to the scan/sustain electrode lines Y, and a data pulse Vd synchronized with the scanning pulse −Vs is applied to the address electrode lines X. At this time, a desired level of direct current voltage for preventing an erroneous discharge is applied to the common sustain electrode lines Z.

In the sustain period, sustaining pulses Vsus having the same pulse width and voltage are alternately applied to the scan/sustain electrode lines Y and the common sustain electrode lines Z to make a sustain discharge of the discharge cells selected by an address discharge.

As described above, the conventional PDP allows sustaining pulses to be alternately applied to the scan/sustain electrode lines and the common sustain electrodes formed in adjacent to each other in the sustain period. For this reason, an erroneous discharge may be caused between the scan/sustain electrode lines and the common sustain electrodes formed adjacently with having the barrier ribs therebetween.

Further, since the scan/sustain electrode lines and the common sustain electrode lines are formed at the center of the discharge cell, the sustain discharge concentrates on the middle portion of the upper substrate to reduce a utility of the discharge space. In other words, a discharge area of the sustain discharge is reduced to cause a deterioration in the light-emission efficiency.

In addition, since the barrier ribs are formed in parallel to the address electrodes, a light generated at a specific discharge cell is provided at the upper/lower portion of the specific discharge cell. In other words, a crosstalk may be generated between the discharge cells arranged in a direction perpendicular to the barrier ribs.

In order to improve the discharge efficiency, there has been suggested a five-electrode, AC surface-discharge PDP as shown in FIG. 4.

Referring to FIG. 4, the conventional five-electrode, AC surface-discharge PDP includes first and second trigger electrodes 34Y and 34Z provided on an upper substrate 30 in such a manner to be positioned at the center of a discharge cell, first and second sustain electrodes 32Y and 32Z provided on the upper substrate 30 in such a manner to be positioned at the edge of the discharge cell, and an address electrode 42X provided at a lower substrate in a direction crossing the trigger electrodes 34Y and 34Z and the first and second sustain electrodes 32Y and 32Z.

On the upper substrate 30 provided with the first sustain electrode 32Y, the first trigger electrode 34Y, the second trigger electrode 34Z and the second sustain electrode 32Z in parallel, an upper dielectric layer 36 and a protective layer 38 are disposed. On the other hand, a lower dielectric layer 44 and a barrier rib 46 are formed on a lower substrate 40 provided with the address electrode 42X, and a fluorescent layer 48 is coated on the surfaces of the lower dielectric layer 44 and the barrier ribs 46.

The trigger electrodes 34Y and 34Z spaced at a narrow distance Ni at the center of the discharge cell are supplied with an alternating pulse in the sustain period to initiate a sustain discharge. The first and second sustain electrodes 32Y and 32Z spaced at a wide distance Wi at the edge of the discharge cell are used to keep a plasma discharge after the discharge was initiated by the trigger electrodes 34Y and 34Z.

An operation process of the five-electrode AC surface-discharge PDP will be described in detail with reference to FIG. 5 below. FIG. 5 is a section view representing a state of rotating the upper substrate by 90° with respect to the lower substrate so as to show up the overall electrode structure within one discharge cell.

First, in the reset period, a reset pulse is applied to the second trigger electrode 34Z of the discharge cell to generate a reset discharge for initializing the discharge cell.

In the address period, a scanning pulse is sequentially applied to the first trigger electrode 34Y and a data pulse synchronized with the scanning pulse is applied to the address electrode X. At this time, an address discharge is generated at the discharge cells supplied with a data.

In the sustain period, a first alternating current pulse is alternately applied to the first and second trigger electrodes 34Y and 34Z. Also, a second alternating current pulse having a higher voltage level than the first alternating current pulse is applied to the first and second electrodes 32Y and 32Z. When the first alternating current pulse is applied, a discharge is initiated between the first and second trigger electrodes 34Y and 34Z. At this time, the first and second sustain electrodes 32Y and 32Z generate a sustain discharge by a priming effect of charged particles caused by said discharge between the first and second trigger electrodes 34Y and 34Z.

In such a conventional five-electrode PDP, a sustain electrode is initiated by utilizing the trigger electrodes 34Y and 34Z, to thereby cause a sustain discharge having a long discharge path.

However, a sustaining pulse is alternately applied to the first and second sustain electrodes formed adjacently each other during the sustain period. Accordingly, an erroneous discharge may be generated between the first and second sustain electrodes formed in parallel with the barrier ribs therebetween.

Furthermore, since the barrier ribs are formed in parallel to the address electrode lines, a light generated at a specific discharge cell is applied to the discharge cells provided at the upper/lower portions of the specific discharge cell. In other words, a crosstalk may be generated between the discharge cells arranged in parallel in a direction perpendicular to the barrier ribs.

SUMMARY OF THE INVENTION

Accordingly, it is an object of the present invention to provide a plasma display panel and a driving method that are capable of improving a discharge efficiency.

A further object of the present invention is to provide a plasma display panel and a driving method that are capable of preventing a crosstalk between the discharge cells.

In order to achieve these and other objects of the invention, a plasma display panel according to one aspect of the present invention includes address electrode included in each discharge cell making a unit pixel of the plasma display panel; a plurality of second sustain electrodes positioned at each periphery of the discharge cell in a direction crossing the address electrode to receive a second sustaining pulse; and at least one of first sustain electrode positioned at the center of the discharge cell in a direction crossing the address electrode to receive a first sustaining pulse applied alternately with respect to the second sustaining pulse. Herein, the first sustain electrode is provided between the second sustain electrodes.

The plasma display panel further includes a bus electrode arranged in parallel to the first sustain electrode at the center of the first sustain electrode. Otherwise, the plasma display panel further includes bus electrodes arranged in parallel to the first sustain electrode at each edge of the first sustain electrode.

The plasma display panel further includes two first sustain electrodes positioned at the center of the discharge cell and provided between the second sustain electrodes.

The plasma display panel further includes a first barrier rib formed in parallel to the address electrode. Also, the plasma display panel further includes a second barrier rib formed in a direction crossing the first barrier rib. Herein, the second barrier rib is provided at an interface of the discharge cells.

The plasma display panel further includes a scan/sustain driver connected to the first sustain electrode to apply the scanning pulse and the first sustaining pulse; and a common sustaining driver connected to the second sustain electrode to apply the second sustaining pulse. Otherwise, the plasma display panel further includes a scan/sustain driver connected to the second sustain electrode to apply the scanning pulse and the first sustaining pulse; and a common sustaining driver connected to the first sustain electrode to apply a reset pulse and the first sustaining pulse.

The plasma display panel further includes a dielectric layer formed in such a manner to cover the first and second sustain electrodes; and at least two floating electrodes formed in parallel to the first and second sustain electrodes at the rear side of the dielectric layer. Herein, the floating electrodes are provided under the second sustain electrodes.

A method of driving a plasma display panel according to another aspect of the present invention includes the steps of applying a reset pulse to at least one electrode of a first sustain electrode and second sustain electrodes so as to initialize a discharge cell; applying a scanning pulse to the first sustain electrode so as to select the discharge cells to be turned on; applying a data pulse synchronized with the scanning pulse to the address electrode; and alternately applying the sustaining pulse to the first and second sustain electrodes so as to discharge the discharge cells to be turned on.

A method of driving a plasma display panel according to still another aspect of the present invention includes the steps of applying a reset pulse to at least one electrode of a first sustain electrode so as to initialize a discharge cell; applying a scanning pulse to the second sustain electrodes so as to select the discharge cells to be turned on; applying a data pulse synchronized with the scanning pulse to the address electrode; and alternately applying the sustaining pulse to the first and second sustain electrodes so as to discharge the discharge cells to be turned on.

A plasma display panel according to still another aspect of the present invention includes a sustain electrode pair positioned at each periphery of discharge cell on an upper substrate; first and second trigger electrodes formed in parallel to the sustain electrode pair between the sustain electrode pair; a dielectric layer coated on the entire surface of the upper substrate in such a manner to cover the sustain electrode pair and the first and second trigger electrodes; and at least two floating electrodes formed in parallel to the sustain electrode pair at the rear side of the dielectric layer. Herein, the floating electrodes are provided under the sustain electrode pair. Each of the floating electrodes has a width smaller than the sustain electrode pair.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
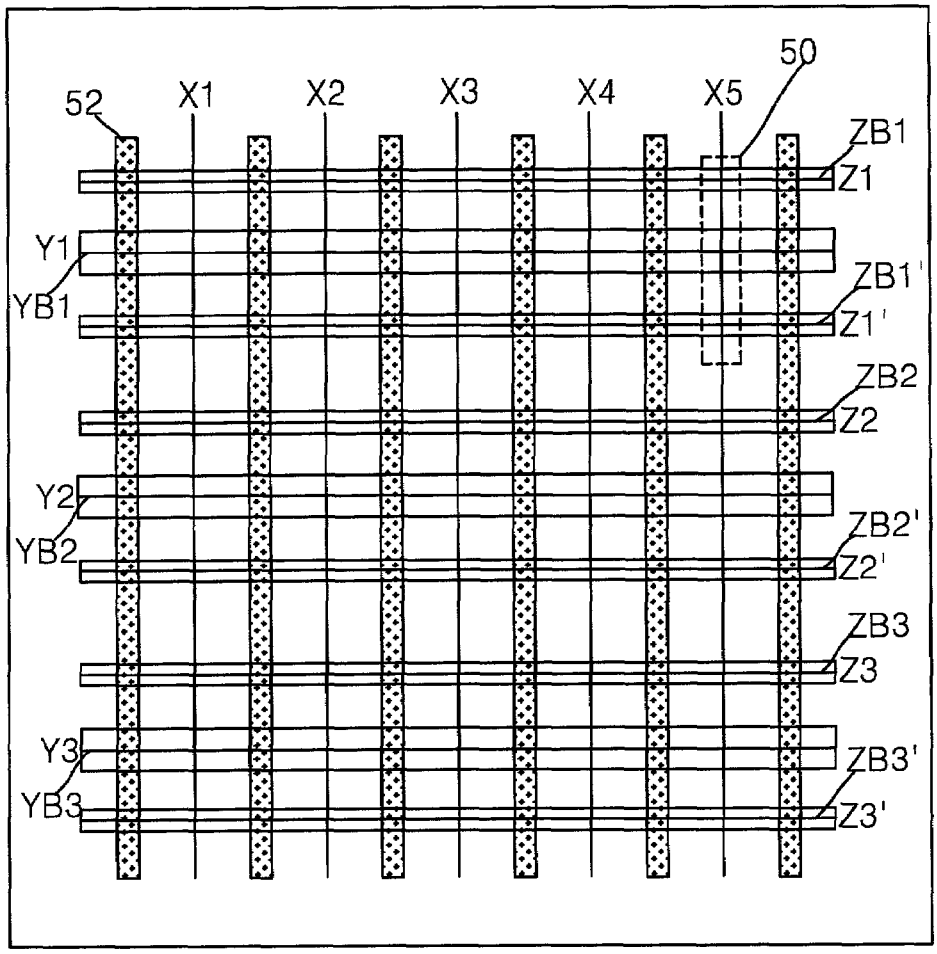
FIG. 6 is a plan view showing an electrode arrangement of a plasma display panel according to a first embodiment of the present invention.

FIG. 6 is a plan view showing an electrode arrangement of a plasma display panel (PDP) according to a first embodiment of the present invention.

Referring to FIG. 6, the PDP according to the first embodiment includes address electrode lines X, first and second common sustain electrode lines Z and Z' formed in a direction crossing the address electrode lines X, and scan/sustain electrode lines Y provided between the first and second common sustain electrode lines Z and Z'.

A discharge cell 50 is positioned at each intersection among the address electrode lines X, the scan/sustain electrode lines Y, the first common sustain electrode lines Z and the second common sustain electrode lines Z'. The scan/sustain electrode lines Y and the first and second common sustain electrode liens Z and Z' are transparent electrodes made from indium-tin-oxide (ITO). Since the ITO has a high resistance value, the rear sides of the scan/sustain electrode lines Y and the first and second common sustain electrode lines Z and Z' are provided with bus electrodes YB, ZB and ZB', respectively such that a uniform voltage can be applied to all the discharge cells 50. The scan/sustain electrode lines Y are set to have wider widths than the first and second sustain electrode lines Z and Z'.

Barrier ribs 52 are formed in parallel to the address electrodes X. The scan/sustain electrode lines Y are positioned at the center of the discharge cell 50. The first and second common sustain electrode lines Z and Z' are positioned at the periphery of the discharge cell with having the scan/sustain electrode lines Y therebetween.

Figure 7:
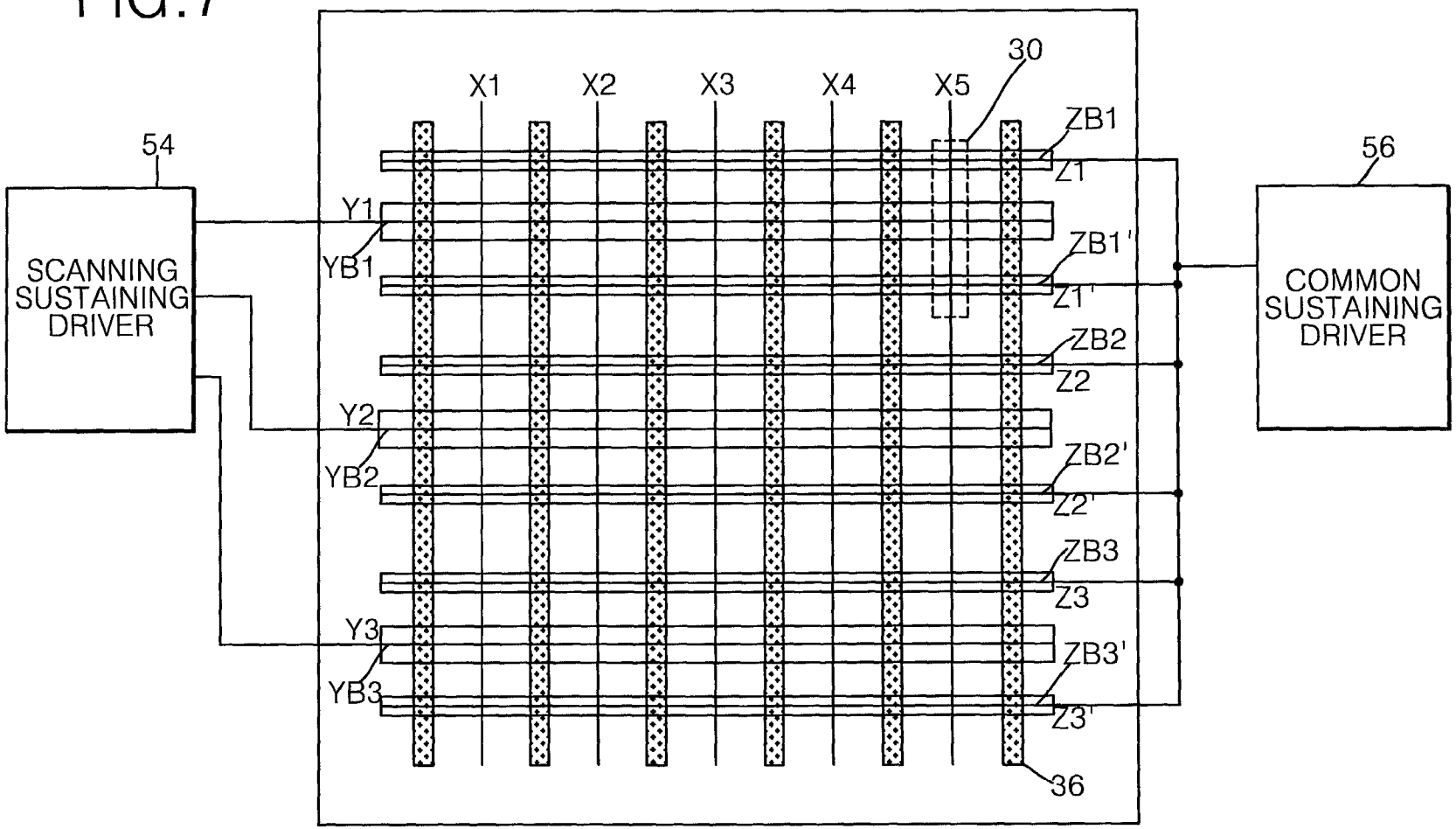
FIG. 7 is a block diagram of a driver applying driving waveforms to the electrodes shown in FIG. 6.

FIG. 7 shows a driving apparatus for the PDP of FIG. 6.

Referring to FIG. 7, the PDP driving apparatus includes a scan/sustain driver 54 for driving the scan/sustain electrode lines Y, and a common sustaining driver 56 for driving the first and second common sustain electrode lines Z and Z'. The scan/sustain driver 54 applies a scanning pulse sequentially and a sustaining pulse to the scan/sustain electrode lines Y. The common sustaining driver 56 applies a sustaining pulse to the first and second common sustain electrode lines Z and Z'. The address electrode lines X receive a picture data synchronized with the scanning pulse from an address driver (not shown). In order to express gray levels, driving waveforms as shown in FIG. 8 are applied to the electrode lines of the PDP.

Figure 8:
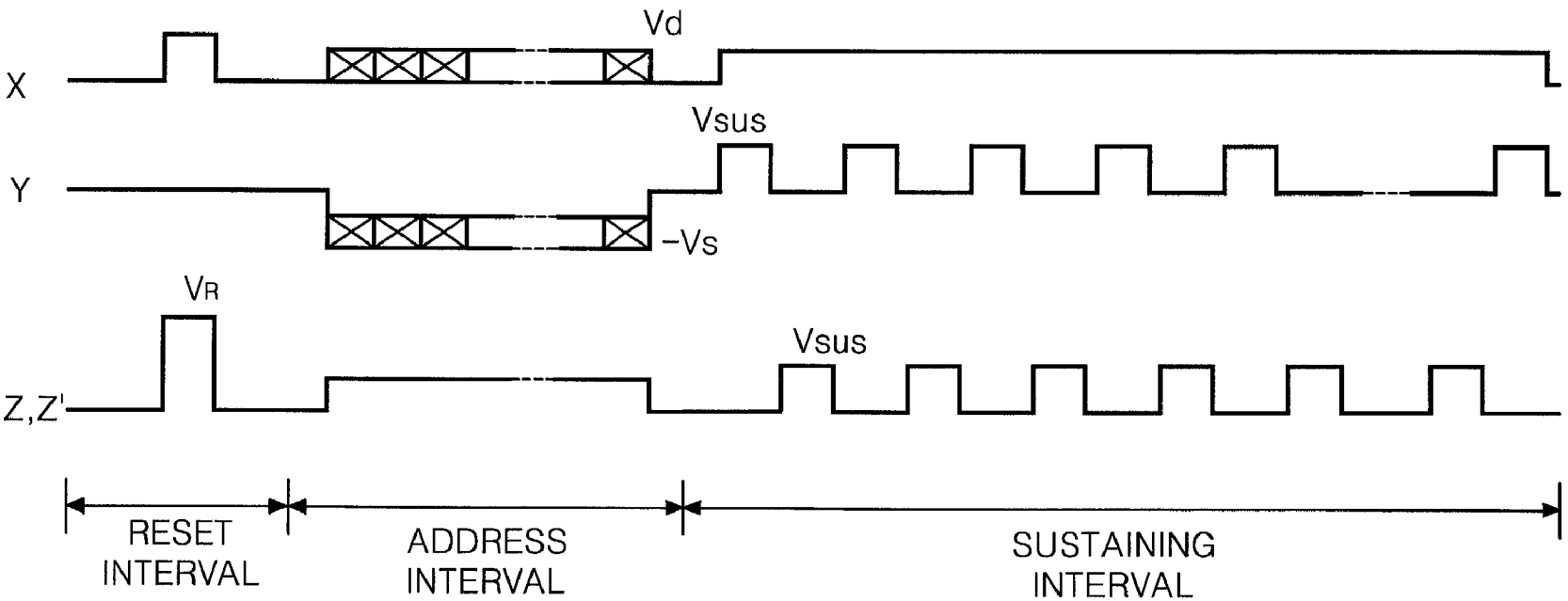
FIG. 8 illustrates driving waveforms applied to the electrodes shown in FIG. 6.
Figure 9:
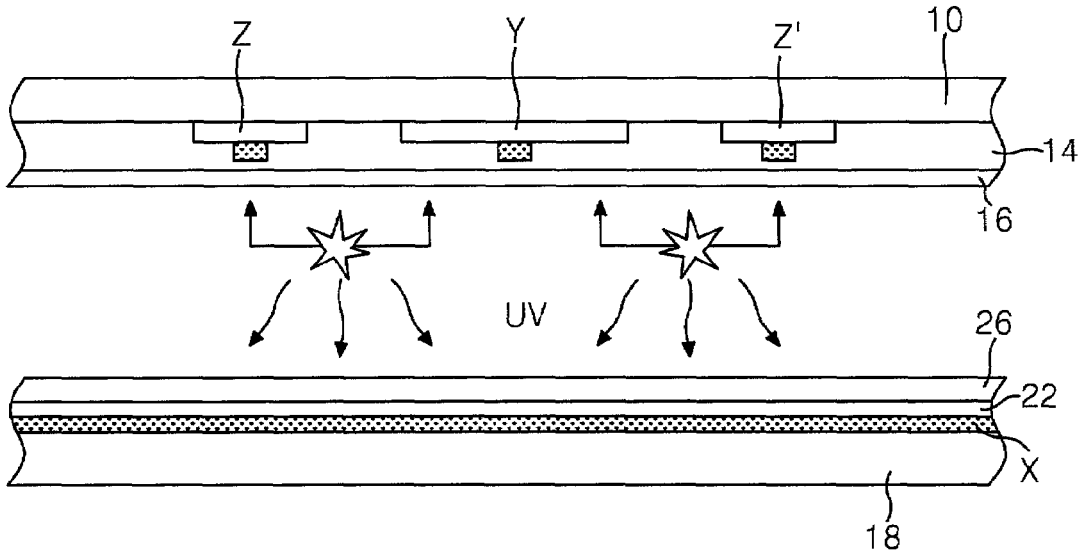
FIG. 9 is a section view representing a sustain discharge generated at the plasma display panel shown in FIG. 6.

Referring to FIG. 8, one sub-field is divided into a reset period for initializing the entire field, an address period for scanning the entire field on a line-sequence basis to write a data, and a sustain period for keeping a light-emission state of the cells into which a data is written.

First, in the reset period, a reset pulse VR is applied to the first and second common sustain electrode lines Z and Z'. The first and second common sustain electrode lines Z and Z' supplied with the reset pulse VR generate a reset discharge with respect to the scan/sustain electrode lines Y. When the reset discharge occurs, uniform charged particles and wall charges are formed at all the discharge cells 50.

In the address period, a scanning pulse −Vs is sequentially applied to the scan/sustain electrode lines Y, and a data pulse Vd synchronized with the scanning pulse −Vs is applied to the address electrode lines X.

In the sustain period, sustaining pulses Vsus having the same pulse width and voltage are alternately applied to the scan/sustain electrode lines Y and the first and second common sustain electrode lines Z and Z' to make a sustain discharge of the discharge cells selected by an address discharge.

Figure 1:
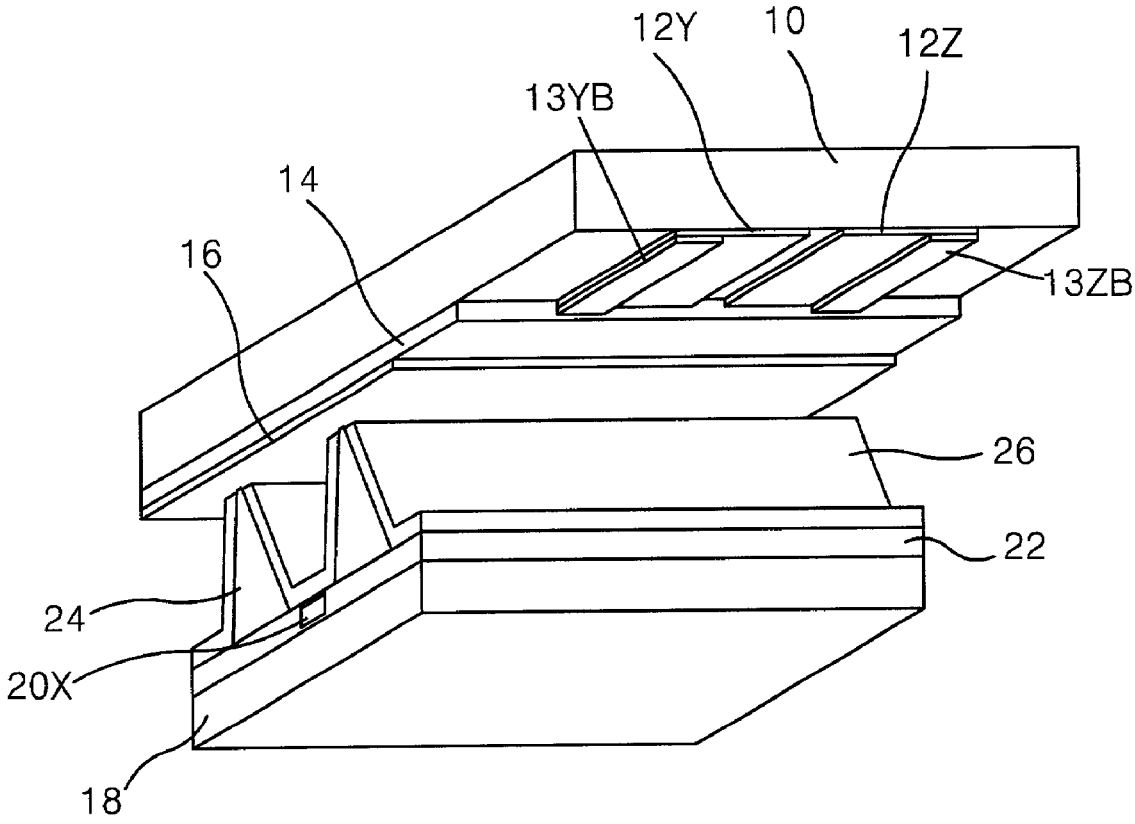
FIG. 1 CONVENTIONAL ART
FIG. 1 is a perspective view showing a discharge cell structure of a conventional three-electrode AC surface-discharge plasma display panel.
Figure 2:
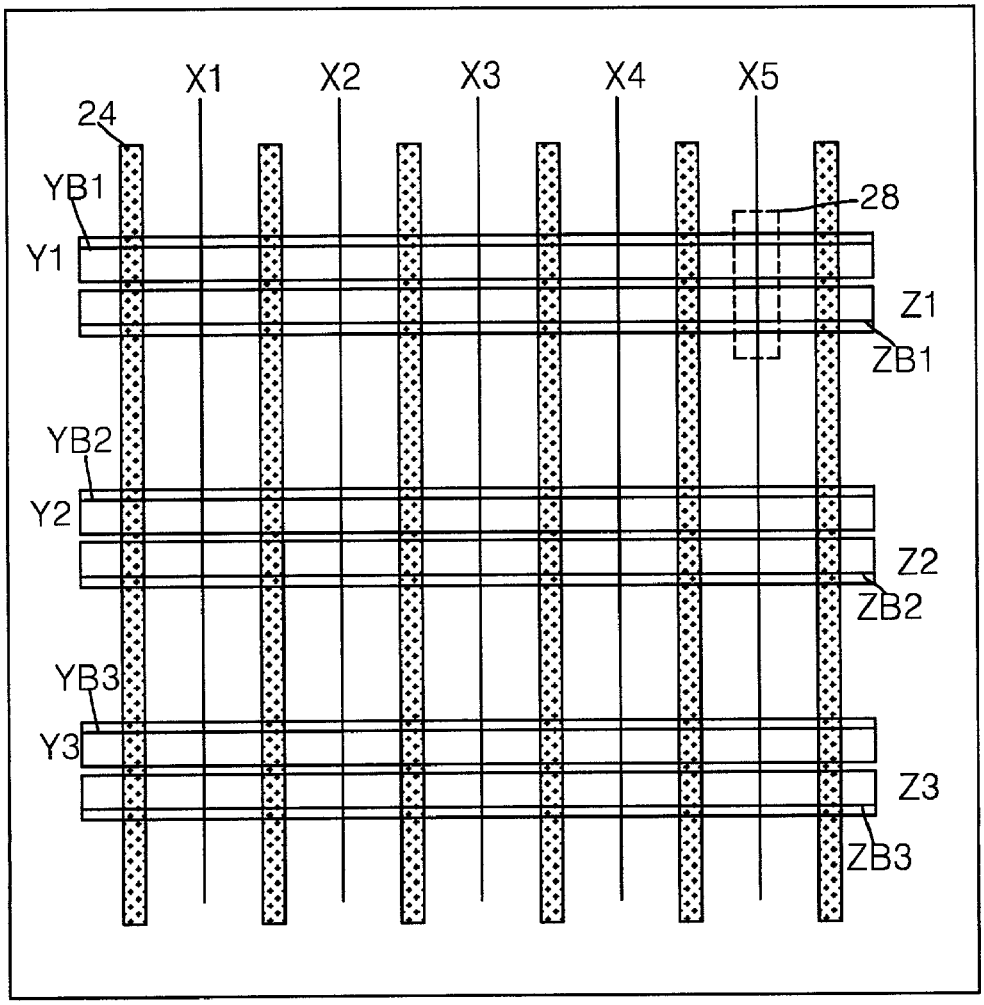
FIG. 2 CONVENTIONAL ART
FIG. 2 is a plan view showing an electrode arrangement of the plasma display panel in FIG. 1.
Figure 3:
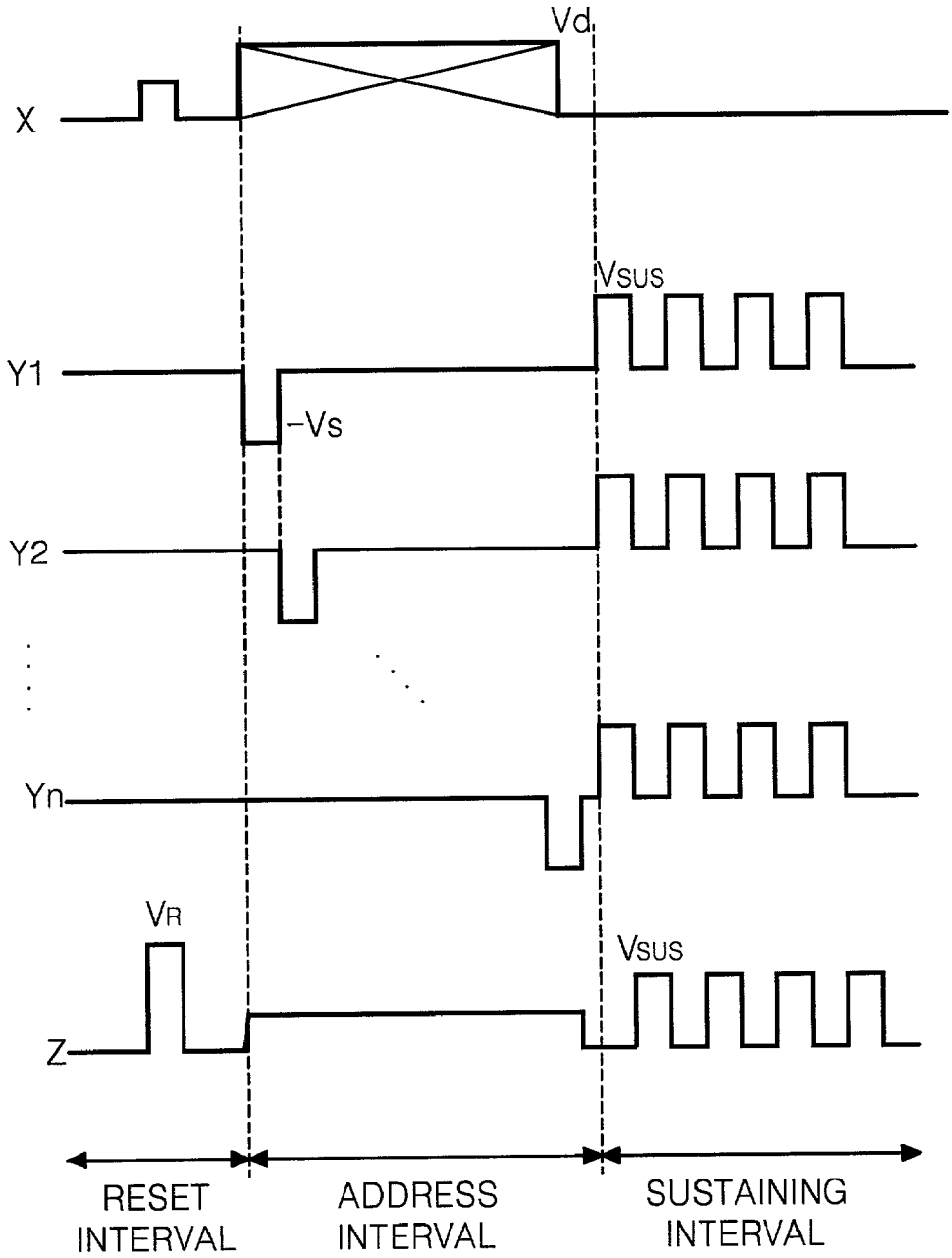
FIG.3 CONVENTIONAL ART
FIG. 3 illustrates driving waveforms applied to the plasma display panel in FIG. 1.
Figure 4:
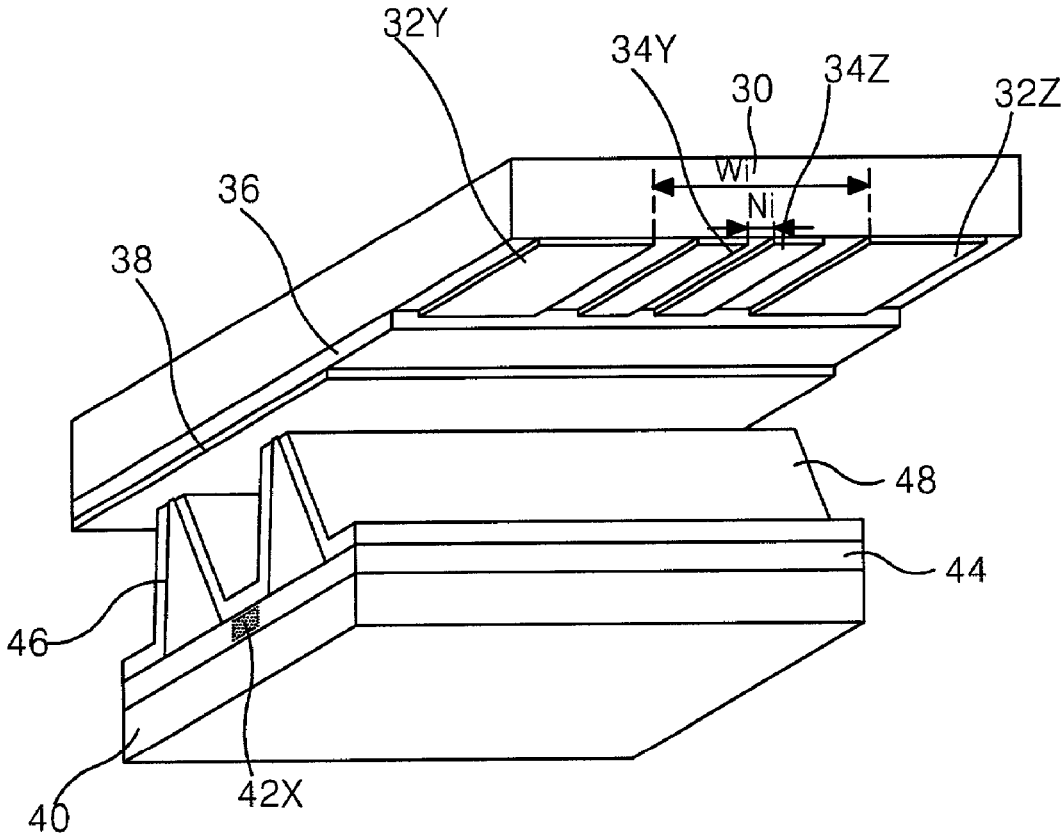
FIG. 4 CONVENTIONAL ART
FIG. 4 is a perspective view showing a discharge cell structure of a conventional five-electrode, AC surface-discharge plasma display panel.
Figure 5:
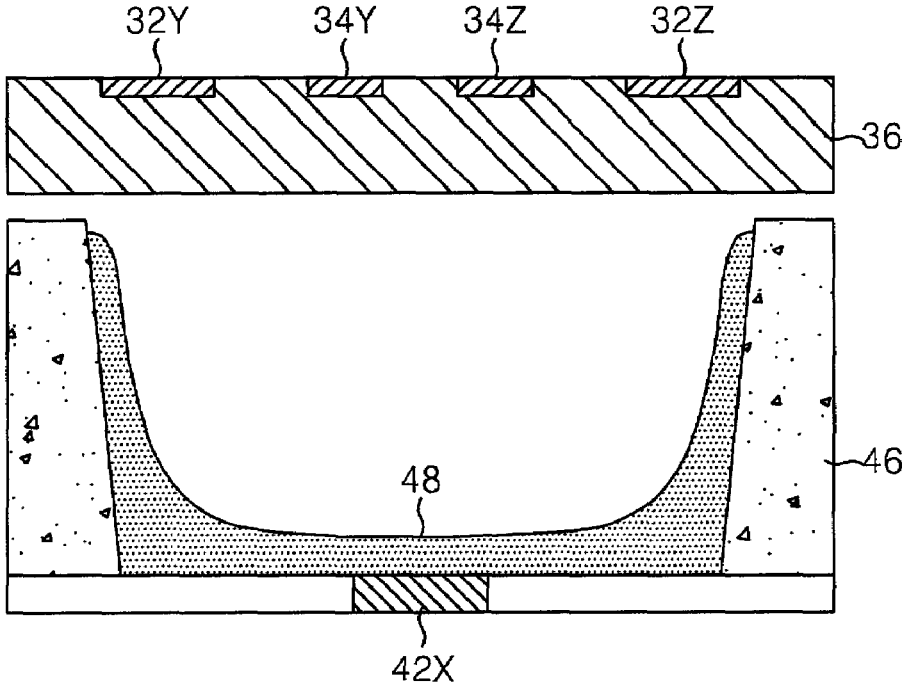
FIG. 5 CONVENTIONAL ART
FIG. 5 is a section view showing a discharge cell structure of the five-electrode AC surface-discharge plasma display panel shown in FIG. 4.

A sustain electrode is generated by the scan/sustain electrode lines Y positioned at the center of the discharge cell 50 and the common sustain electrode lines Z and Z' positioned at the periphery of the discharge cell 50. In other words, a sustain discharge having a long discharge path is generated between the first and second common sustain electrodes Z and Z'. If a sustain discharge having a long discharge path is generated as mentioned above, then a generated amount of an ultraviolet ray can be not only increased, but also a light-emission area can be enlarged to improve a light-emission efficiency. Herein, elements of the PDP according to the first embodiment having the same construction as those of the PDP shown in FIG. 1 have been given to the same reference numerals.

According to the first embodiment of the present invention, an erroneous discharge, that is, a crosstalk between the adjacent discharge cells 50 can be prevented. More specifically, the first and second common sustain electrode lines Z and Z' are supplied with identical pulses in the sustain period. Because the first and second common sustain electrode lines Z and Z' provided at the periphery of the adjacent discharge cells 50 receives the same pulse, a crosstalk between the discharge cells 50 can be prevented.

Figure 10:
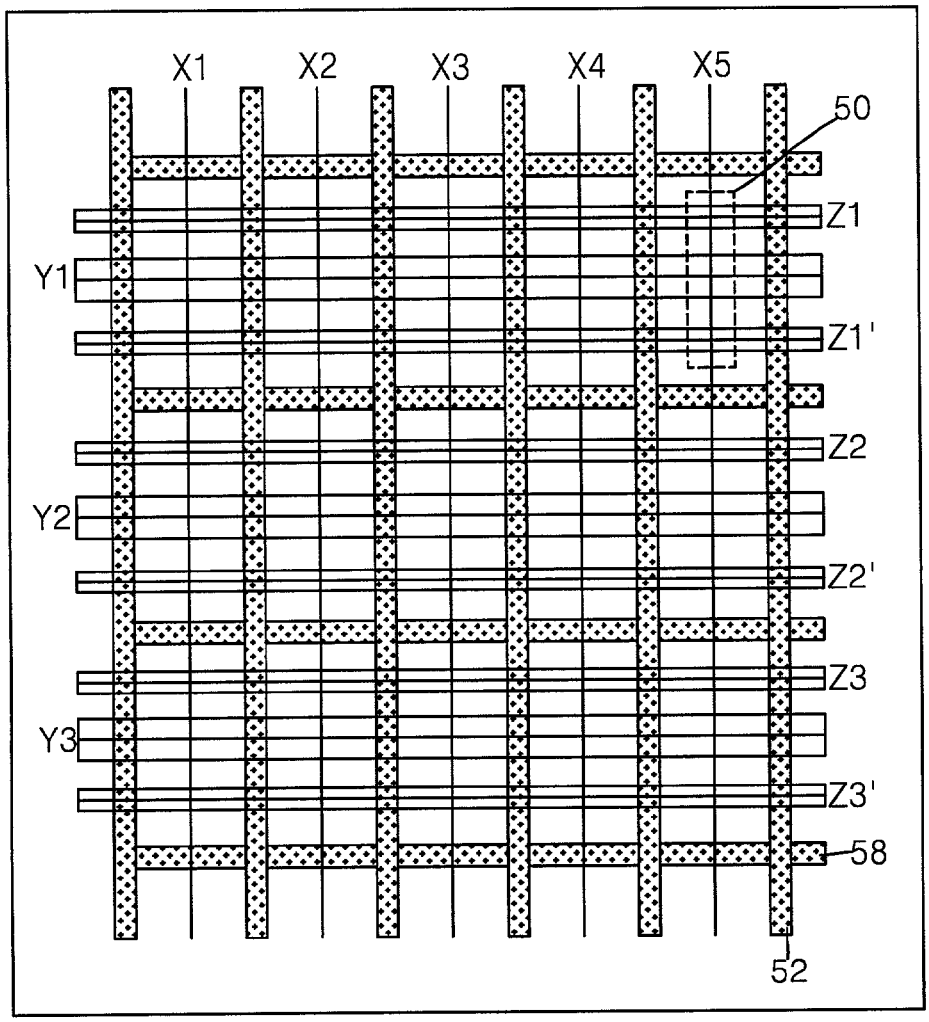
FIG. 10 is a plan view representing barrier ribs provided additionally at the plasma display panel shown in FIG. 6.

The PDP according to the first embodiment further may include second barrier ribs 58 formed in parallel to the common sustain electrode lines Z and Z' as shown in FIG. 10. The second barrier ribs 58 are provided at the upper and lower portions of the discharge cell 50 to prevent a light generated by a discharge from being supplied to the discharge cells formed in adjacent to the upper and lower portion thereof.

Figure 11:
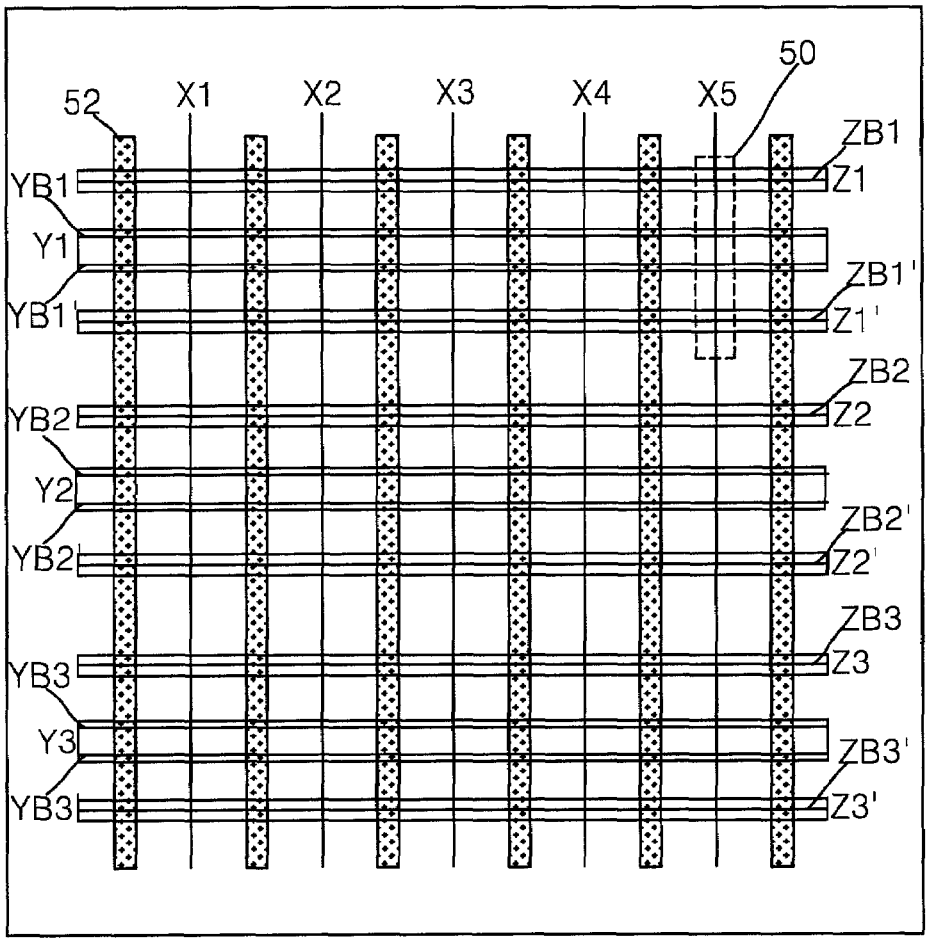
FIG. 11 is a plan view showing an electrode arrangement of a plasma display panel according to a second embodiment of the present invention.

FIG. 11 is a plan view showing an electrode arrangement of a plasma display panel (PDP) according to a second embodiment of the present invention.

Referring to FIG. 11, the PDP according to the second embodiment includes address electrode lines X, first and second common sustain electrode lines Z and Z' formed in a direction crossing the address electrode lines X, and scan/sustain electrode lines Y provided between the first and second common sustain electrode lines Z and Z'.

A discharge cell 50 is positioned at each intersection among the address electrode lines X, the scan/sustain electrode lines Y, the first common sustain electrode lines Z and the second common sustain electrode lines Z'. The scan/sustain electrode lines Y and the first and second common sustain electrode lines Z and Z' are transparent electrodes made from indium-tin-oxide (ITO). Since the ITO has a high resistance value, the rear sides of the scan/sustain electrode lines Y and the first and second common sustain electrode lines Z and Z' are provided with bus electrodes YB, YB', ZB and ZB', respectively such that a uniform voltage can be applied to all the discharge cells 50. Please note that, although one bus electrode YB is provided at the scan/sustain electrode line Y in the first embodiment, two bus electrodes YB and YB' are provided at the scan/sustain electrode Y in the second embodiment.

In the first embodiment, a single bus electrode YB is provided at the scan/sustain electrode line Y having a large width. If one bus electrode YB is provided at the scan/sustain electrode line Y having a large width, then a voltage drop may occur due to a resistance value of the scan/sustain electrode line Y made from the ITO.

In light of this, the second embodiment provides two bus electrodes YB and YB' at the periphery of the scan/sustain electrode line Y, thereby preventing a voltage drop of the scan/sustain electrode line Y and lowered discharge voltage easily wall charges at the discharge cell.

The PDP according to the second embodiment may further include second barrier ribs 58 formed in parallel to the first and second common sustain electrode lines Z and Z' like the first embodiment. Since a driving waveform and an operation process in the second embodiment are identical to those in the first embodiment, an explanation as to them is omitted.

Figure 12:
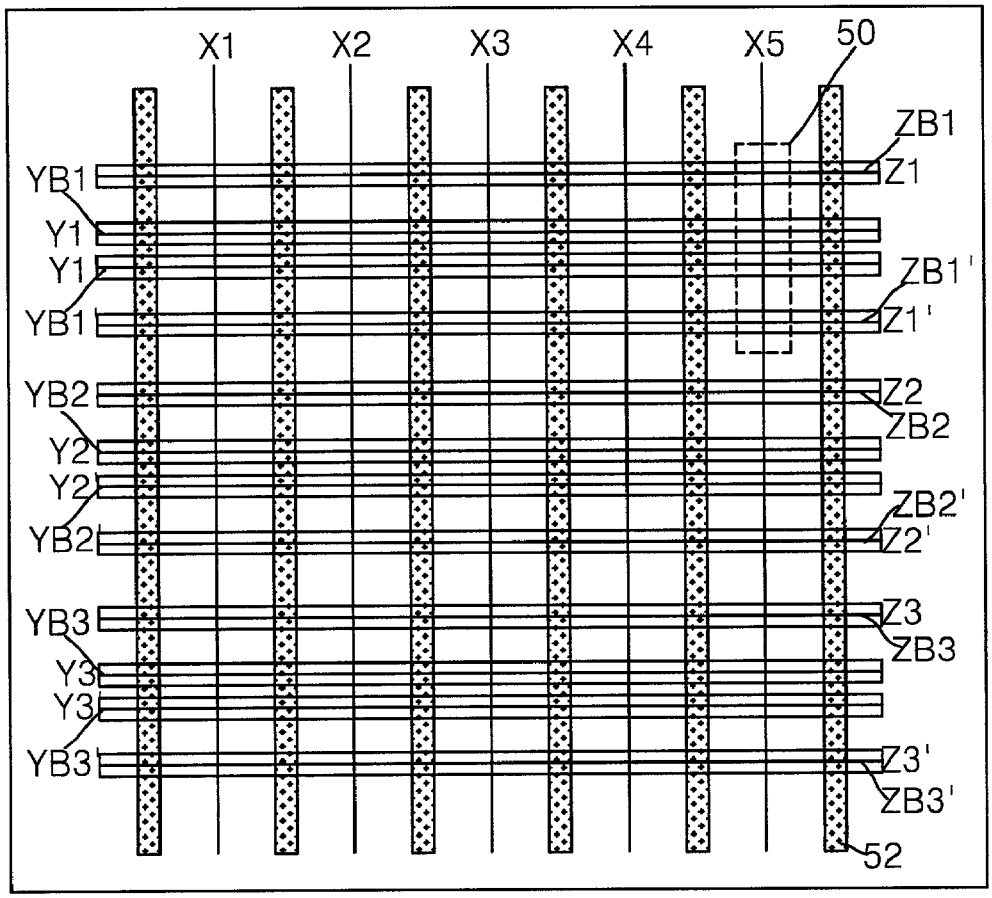
FIG. 12 is a plan view showing an electrode arrangement of a plasma display panel according to a third embodiment of the present invention.

FIG. 12 is a plan view showing an electrode arrangement of a plasma display panel (PDP) according to a third embodiment of the present invention.

Referring to FIG. 12, the PDP according to the third embodiment includes address electrode lines X, first and second common sustain electrode lines Z and Z' formed in a direction crossing the address electrode lines X, and first and second scan/sustain electrode lines Y and Y' provided between the first and second common sustain electrode lines Z and Z'.

A discharge cell 50 is positioned at each intersection among the first scan/sustain electrode line Y, the second scan/sustain electrode lines Y', the first common sustain electrode lines Z and the second common sustain electrode lines Z'. The first and second scan/sustain electrode lines Y and Y' and the first and second common sustain electrode liens Z and Z' are transparent electrodes made from indium-tin-oxide (ITO). Since the ITO has a high resistance value, the rear sides of the first and second scan/sustain electrode lines Y and Y' and the first and second common sustain electrode lines Z and Z' are provided with bus electrodes YB, YB', ZB and ZB', respectively such that a uniform voltage can be applied to all the discharge cells 50.

Barrier ribs 52 are formed in parallel to the address electrode lines X. The first and second scan/sustain electrodes Y and Y' are positioned at the center of the discharge cell 50. The first and second common sustain electrode lines Z and Z' are positioned at the periphery of the discharge cell 50 with having the first and second scan/sustain electrode lines Y and Y' therebetween. Please note that, although a single scan/sustain electrode line Y have been provided at the center of the discharge cell in the first embodiment, two scan/sustain electrode lines Y and Y' are provided at the center of the discharge cell 50 in the third embodiment.

If a single scan/sustain electrode line Y is provided at the center of the discharge cell 50 like the first embodiment, then any one of the common electrode lines Z and Z' first generates a discharge with respect to the scan/sustain electrode line Y in the sustain period and this discharge is unstable. However, if two scan/sustain electrode lines Y and Y' are provided at the center of the discharge cell 50 like the third embodiment, then a sustain discharge is generated between the first common sustain electrode line Z and the first scan/sustain electrode line Y in the sustain period. Also, a sustain discharge is generated between the second common sustain electrode line Z' and the second scan/sustain electrode line Y' in the sustain period. The PDP according to the third embodiment can generate a stable sustain discharge within the discharge cell 50.

Figure 13:
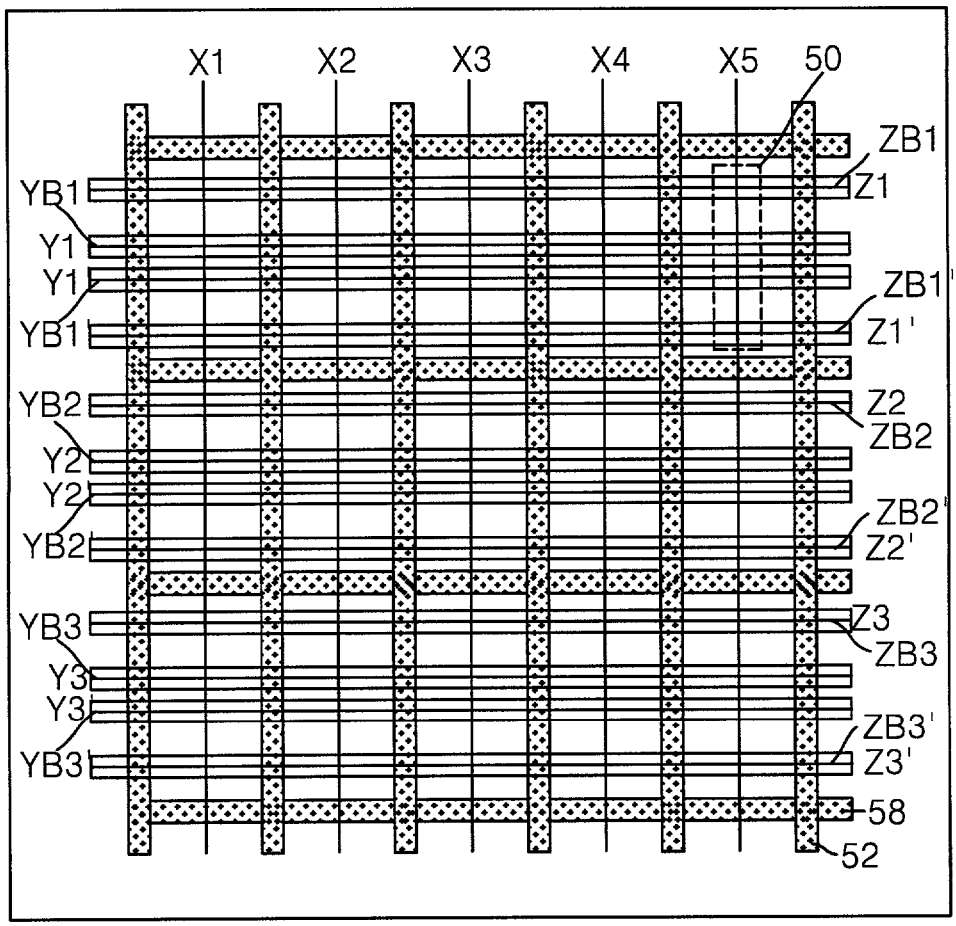
FIG. 13 is a plan view representing barrier ribs provided additionally at the plasma display panel shown in FIG. 12.

The PDP according to the third embodiment may further include second barrier ribs 58 formed in parallel to the first and second common sustain electrode lines Z and Z' as shown in FIG. 13. Since a driving waveform and an operation process in the third embodiment are identical to those in the first embodiment, an explanation as to them is omitted.

Figure 14:
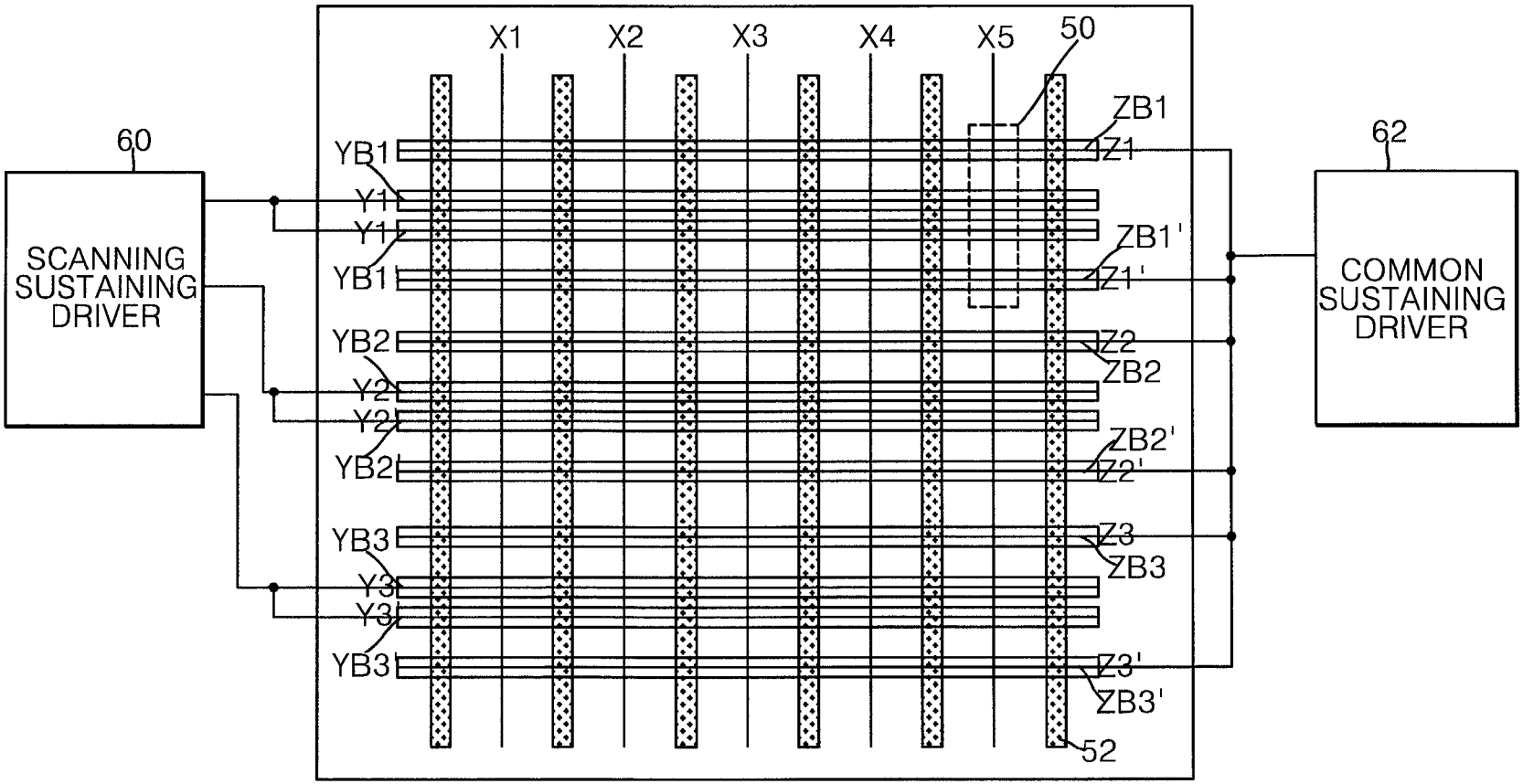
FIG. 14 is a block diagram showing a configuration of a driving apparatus for the plasma display panel shown in FIG. 12.

FIG. 14 shows a driving apparatus for the PDP of FIG. 12.

Referring to FIG. 14, a driving apparatus for the PDP according to the third embodiment of the present invention includes a scan/sustain driver 60 for driving the first and second scan/sustain electrode lines Y and Y', and a common sustaining driver 62 for driving the first and second common sustain electrode lines Z and Z'. The scan/sustain driver 60 applies a scanning pulse sequentially and a sustaining pulse to the first and second scan/sustain electrode lines Y and Y'. At this time, the first and second scan/sustain electrode lines Y and Y' receive the same driving waveform from the scan/sustain driver 60.

The common sustaining driver 62 applies a sustaining pulse to the first and second common sustain electrode lines Z and Z'. The address electrode lines X receive a picture data synchronized with the scanning pulse from an address driver (not shown).

Figure 15:
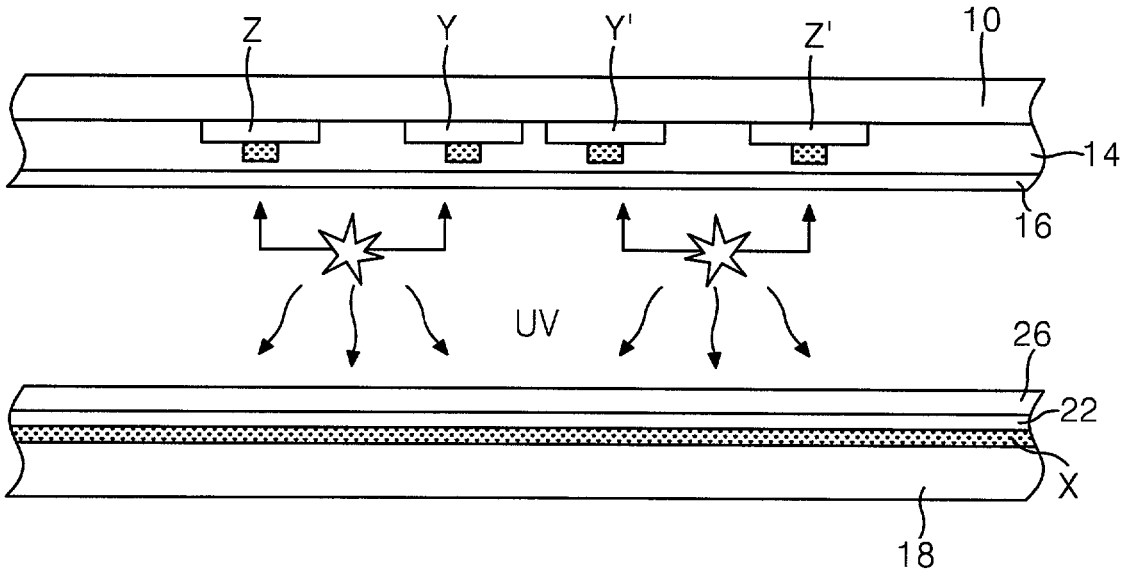
FIG. 15 is a plan view representing a sustain discharge generated at the plasma display panel shown in FIG. 12.

In the sustain period, sustaining pulses Vsus having the same pulse width and voltage are alternately applied to the first and second scan/sustain electrode lines Y and Y' and the first and second common sustain electrode lines Z and Z'. If the sustaining pulses Vsus are alternately applied, then a sustain discharge is generated between the first common sustain electrode line Z and the first scan/sustain electrode line Y while being generated between the second common sustain electrode line Z' and the second scan/sustain electrode line Y' as shown in FIG. 15.

In other words, a sustain discharge is generated between the first and second scan/sustain electrode lines Y and Y' provided at the center of the discharge cell and the first and second common sustain electrode line Z and Z' provided at the periphery of the discharge cell 50, respectively, so that the discharge can be efficiently utilized. Further, each discharge cell 50 is provided with four sustain electrodes Y. Y', Z and Z', so that a stable sustain discharge can be obtained.

Figure 16:
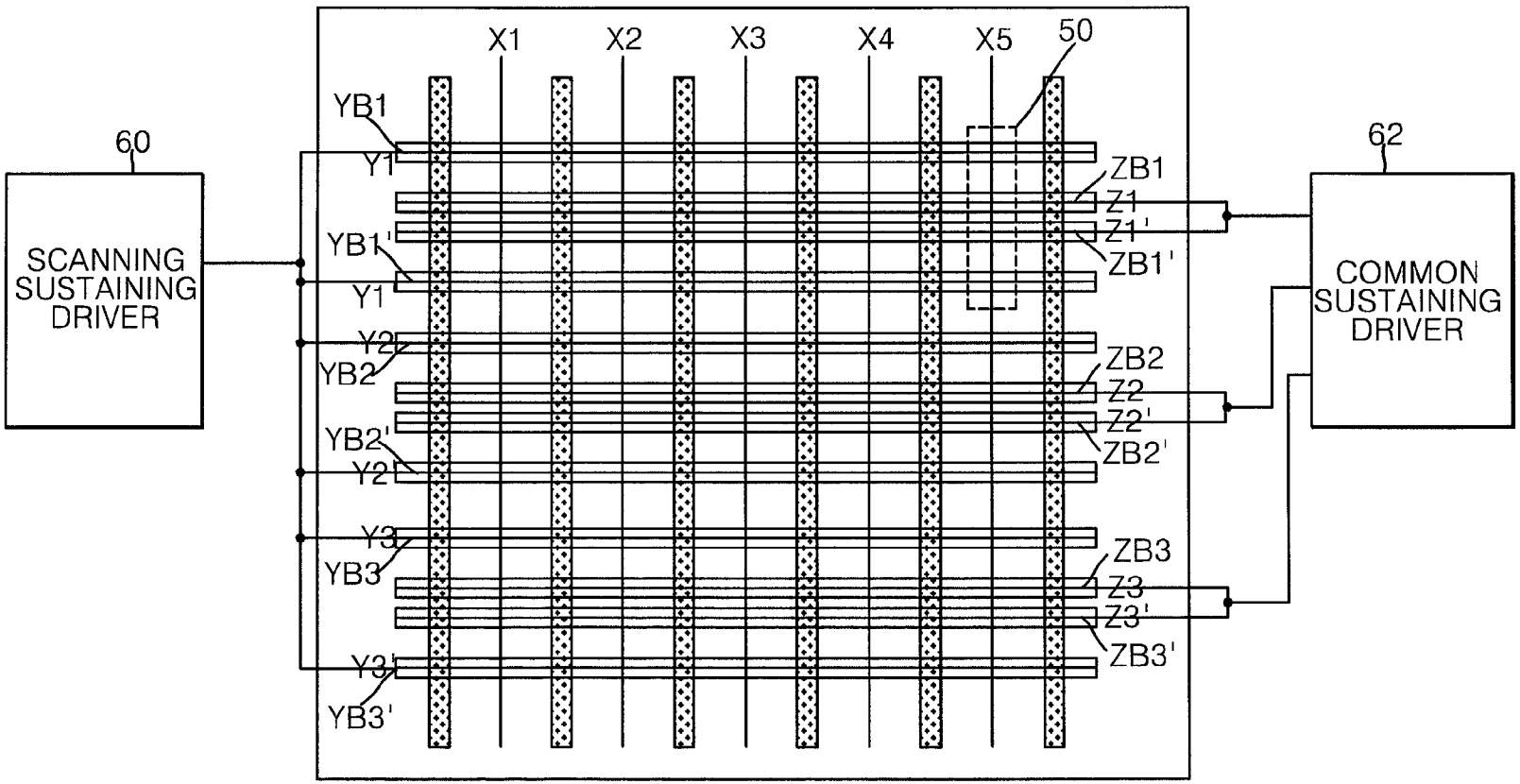
FIG. 16 is a block diagram showing a configuration of a driving apparatus for a plasma display panel according to a fourth embodiment of the present invention.

In the first to third embodiments of the present invention as described above, the electrodes provided at the center of the discharge cell 50 have been used as the scan/sustain electrode lines Y and Y' and the electrodes provided at the periphery of the discharge cell 50 has been used as the common sustain electrode lines Z and Z'. Otherwise, the electrodes provided at the center of the discharge cell 50 may be used as the common sustain electrode lines Z and Z' and the electrodes provided at the periphery of the discharge cell 50 may be used as the scan/sustain electrode lines Y and Y', like a fourth embodiment as shown in FIG. 16.

Figure 17:
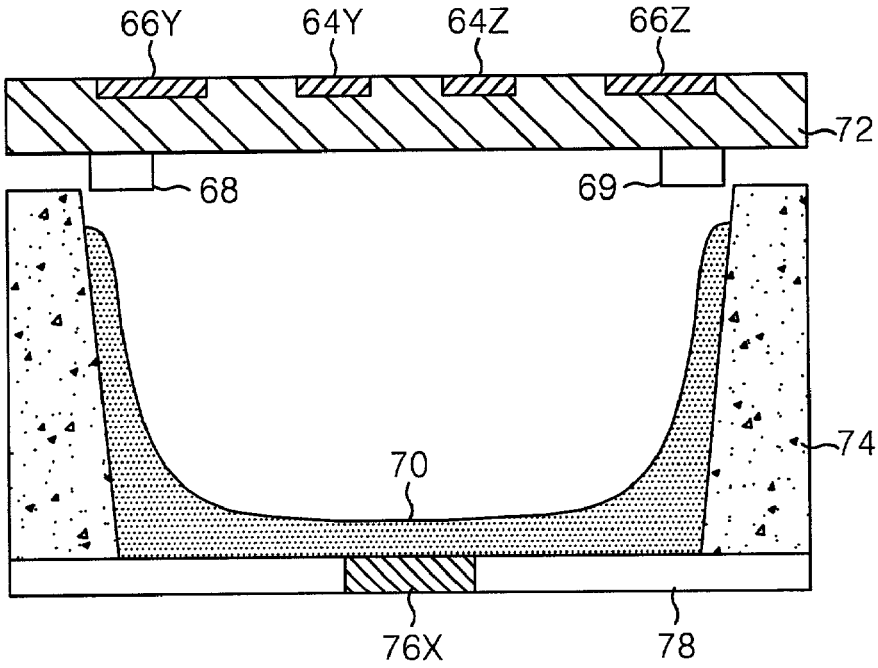
FIG. 17 is a section view showing a discharge cell structure of a plasma display panel according to a fifth embodiment of the present invention.

FIG. 17 shows a discharge cell of a PDP according to a fifth embodiment of the present invention, which has a structure of adding floating electrodes 68 and 69. FIG. 17 represents a state of rotating an upper substrate by 90° with respect to a lower substrate so as to show up the entire electrode structure within one discharge cell.

Referring to FIG. 17, the PDP according to the fifth embodiment includes first and second trigger electrodes 64Y and 64Z provided on an upper dielectric layer 72 in such a manner to be positioned at the center of a discharge cell, first and second sustain electrodes 66Y and 66Z provided on the upper dielectric layer 72 in such a manner to be positioned at the edge of the discharge cell, first and second floating electrodes 68 and 69 provided at the rear side of the upper dielectric layer 72, and an address electrode 76X provided at a lower dielectric layer 78 in a direction crossing the first and second sustain electrodes 66Y and 66Z. Barrier ribs 74 are provided between the upper dielectric layer 72 and the lower dielectric layer 78, and a fluorescent layer 70 is coated on the surfaces of the lower dielectric layer 78 and the barrier ribs 74.

The trigger electrodes 64Y and 64Z spaced at a small distance at the center of the discharge cell is supplied with an alternating current pulse in the sustain period to thereby initiate a sustain discharge. The first and second sustain electrodes 66Y and 66Z spaced at a large distance at the edge of the discharge are used to keep a plasma discharge after said discharge was initiated by the trigger electrodes 64Y and 64Z. The address electrode 76X plays a role to receive a data pulse in the address period to thereby cause an address discharge with respect to the first trigger electrode 64Y supplied with a scanning pulse.

Figure 18:
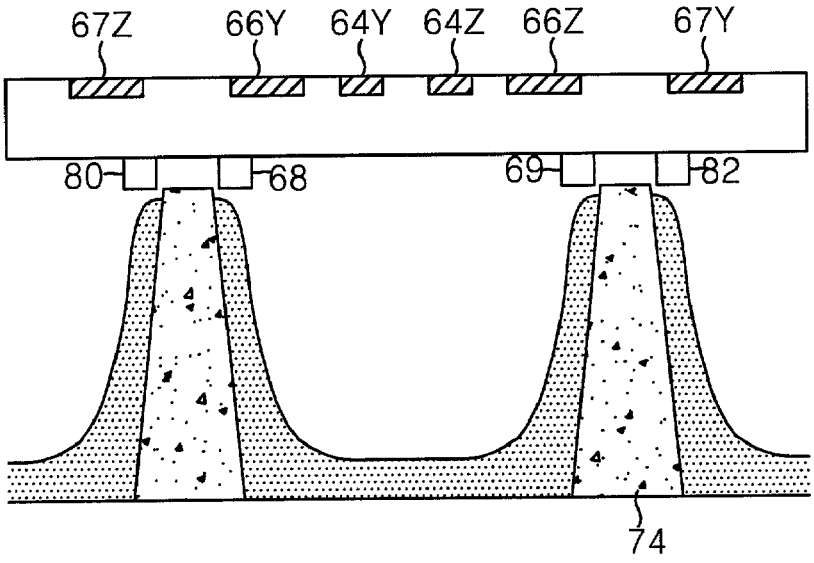
FIG. 18 is a section view representing an adjacent discharge cell structure of the AC surface-discharge plasma display panel shown in FIG. 17.

The floating electrodes 68 and 69 are arranged in parallel to the first and second sustain electrodes 66Y and 66Z, and have smaller width than the first and second sustain electrodes 66Y and 66Z. The floating electrodes 68 and 69 prevent a crosstalk from being generated between the adjacent discharge cells. This will be described with reference to FIG. 18 below.

In the sustain period, an alternating current pulse is alternately applied to the first and second sustain electrodes 66Y and 66Z. When a desired level of alternating current pulse is applied to the first sustain electrode 66Y, a voltage equal to a half voltage of the alternating current pulse applied to the first sustain electrode 66Y is derived into the floating electrode 68 provided under the first sustain electrode 66Y.

Accordingly, an erroneous discharge against the second sustain electrode 67Z formed adjacently with having the barrier rib 74 therebetween can be prevented. In other words, a floating electrode 80 formed adjacently with having the barrier rib 74 remains at a higher level than a ground potential applied to the second sustain electrode 67Z. As a result, a low voltage difference is generated between the floating electrodes 68 and 80, so that an erroneous discharge between the floating electrodes 68 and 80 can be prevented.

Further, when a desired voltage level of alternating current pulse is applied to the second sustain electrode 66Z, a voltage equal to a half voltage of the alternating current pulse applied to the second sustain electrode 66Z is derived into the floating electrode 69 provided under the second sustain electrode 66Z. Accordingly, an erroneous discharge between the floating electrodes 69 and 82 formed adjacently with having the barrier rib 74 therebetween can be prevented. Such a fifth embodiment is applicable to the first and fourth embodiments of the present invention.

As described above, according to the present invention, a sustain discharge is generated between at least one of first electrode provided at the center of the discharge cell and two second electrodes provided at the periphery of the discharge cell, so that the discharge space can be efficiently utilized. In other words, a sustain discharge is generated between the first electrode and the second electrode to thereby cause a sustain discharge having a long discharge path. Furthermore, two second electrodes are provided at the periphery of the discharge cell with having the first electrode therebetween, so that a crosstalk between the discharge cells can be prevented. Also, the barrier ribs are additionally provided in parallel to the first and second electrodes, so that a crosstalk between the discharge cells located at the upper and lower portions can be prevented.

Moreover, the floating electrodes are provided under the second electrode provided at the periphery of the discharge cell, so that a crosstalk between the adjacent discharge cells cane be prevented.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

an address electrode included in each discharge cell making a unit pixel of the plasma display panel;

a plurality of second sustain electrodes positioned at each periphery of the discharge cell in a direction crossing the address electrode to receive a second sustaining pulse; and at least one of first sustain electrodes positioned at the center of the discharge cell in a direction crossing the address electrode to receive a first sustaining pulse applied alternately with respect to the second sustaining pulse, wherein the plurality of second sustain electrodes is unique to each of the discharge cells associated with the address electrode.

2. The plasma display panel as claimed in claim 1, wherein the first sustain electrodes are provided between the second sustain electrodes.

3. The plasma display panel as claimed in claim 1, further comprising:

a bus electrode arranged in parallel to the first sustain electrode at the center of the first sustain electrode.

4. The plasma display panel as claimed in claim 1, further comprising:

bus electrodes arranged in parallel to the first sustain electrode at each edge of the first sustain electrode.

5. The plasma display panel as claimed in claim 1, further comprising:

two first sustain electrodes positioned at the center of the discharge cell and provided between the second sustain electrodes.

6. The plasma display panel as claimed in claim 1, further comprising:

a first barrier rib formed in parallel to the address electrode.

7. The plasma display panel as claimed in claim 6, further comprising:

a second barrier rib formed in a direction crossing the first barrier rib.

8. The plasma display panel as claimed in claim 7, wherein the second barrier rib is provided at an interface of the discharge cells.

9. The plasma display panel as claimed in claim 1, further comprising:

a scan/sustain driver connected to the first sustain electrode to apply the scanning pulse and the first sustaining pulse; and a common sustaining driver connected to the second sustain electrode to apply the second sustaining pulse.

10. The plasma display panel as claimed in claim 1, further comprising:

a scan/sustain driver connected to the second sustain electrode to apply the scanning pulse and the second sustaining pulse; and a common sustaining driver connected to the first sustain electrode to apply a reset pulse and the first sustaining pulse.

11. The plasma display panel as claimed in claim 1, further comprising:

a dielectric layer formed in such a manner to cover the first and second sustain electrodes; and at least two floating electrodes formed in parallel to the first and second sustain electrodes at the rear side of the dielectric layer.

12. The plasma display panel as claimed in claim 11, wherein the floating electrodes are provided under the second sustain electrodes.

13. A method of driving a plasma display panel including a plurality of second sustain electrodes positioned at each periphery of a discharge cell, an address electrode arranged in a direction crossing the second sustain electrodes, and at least one of first sustain electrode formed in parallel to the second sustain electrodes between the second sustain electrodes, said method comprising the steps of:

applying a reset pulse to at least one electrode of the first sustain electrode and the second sustain electrodes so as to initialize the discharge cell, wherein the plurality of second sustain electrode is unique to each of the discharge cells associated with the address electrode;

applying a scanning pulse to the first sustain electrode so as to select the discharge cells to be turned on;

applying a data pulse synchronized with the scanning pulse to the address electrode; and alternately applying the sustaining pulse to the first and second sustain electrodes so as to discharge the discharge cells to be turned on.

14. A method of driving a plasma display panel including a plurality of second sustain electrodes positioned at each periphery of a discharge cell, an address electrode arranged in a direction crossing the second sustain electrodes, and at least one of first sustain electrode formed in parallel to the second sustain electrodes between the second sustain electrodes, said method comprising the steps of:

applying a reset pulse to at least one electrode of the first sustain electrode so as to initialize the discharge cell;

applying a scanning pulse to the second sustain electrodes so as to select the discharge cells to be turned on, wherein the plurality of second sustain electrode is unique to each of the discharge cells associated with the address electrode;

applying a data pulse synchronized with the scanning pulse to the address electrode; and alternately applying the sustaining pulse to the first and second sustain electrodes so as to discharge the discharge cells to be turned on.

15. A plasma display panel, comprising:

an address electrode included in each discharge cell making a unit pixel of the plasma display panel;

a plurality of second sustain electrodes positioned at each periphery of the discharge cell in a direction crossing the address electrode to receive a second sustaining pulse;

at least one of first sustain electrodes positioned at the center of the discharge cell in a direction crossing the address electrode to receive a first sustaining pulse applied alternately with respect to the second sustaining pulse; and two first sustain electrodes positioned at the center of the discharge cell and provided between the second sustain electrodes.

16. A plasma display panel, comprising:

an address electrode included in each discharge cell making a unit pixel of the plasma display panel;

a plurality of second sustain electrodes positioned at each periphery of the discharge cell in a direction crossing the address electrode to receive a second sustaining pulse;

at least one of first sustain electrodes positioned at the center of the discharge cell in a direction crossing the address electrode to receive a first sustaining pulse applied alternately with respect to the second sustaining pulse;

a scan/sustain driver connected to the second sustain electrode to apply the scanning pulse and the second sustaining pulse; and a common sustaining driver connected to the first sustain electrode to apply a reset pulse and the first sustaining pulse.

17. A display panel, comprising:

a plurality of first sustain electrodes in a first direction;

a plurality of second sustain electrodes in the first direction; and a plurality of address electrodes in a second direction, which is different from the first direction such that the plurality of first and second sustain electrodes cross with the plurality of address electrodes, wherein there are at least more than two second sustain electrodes than the first sustain electrode, wherein a plurality of discharge cells are associated with each of the plurality of address electrodes, and the plurality of second sustain electrodes is unique to each of the plurality of address electrodes for each discharge cell.

18. The display panel of claim 17, wherein the plurality of first sustain electrodes are scan electrodes.

19. The display panel of claim 17, wherein the plurality of second sustain electrodes are common sustain electrodes.

20. The display panel of claim 17, wherein there are twice as many second sustain electrodes than the first sustain electrodes.

* * * * *